United States Patent [19]

Weiss

[11] 3,944,131

[45] Mar. 16, 1976

[54] MULTI-SIZE MAILING CARTON

[76] Inventor: Adolph Weiss, 256 Georgia Ave., Brooklyn, N.Y. 11207

[22] Filed: July 18, 1974

[21] Appl. No.: 489,782

[52] U.S. Cl. ..... 229/40; 206/424

[51] Int. Cl.[2] ..... B65D 5/02

[58] Field of Search ..... 229/40, 17 G, 54 R, 53, 229/8, DIG. 3; 206/424, 521

[56] References Cited

UNITED STATES PATENTS

| | | | |
|---|---|---|---|
| 2,333,123 | 11/1943 | Ringler | 229/17 G |
| 2,395,663 | 2/1946 | Howard | 229/37 R |
| 2,625,318 | 1/1953 | Ross | 229/54 R |
| 2,787,408 | 4/1957 | André | 229/16 R |
| 3,001,686 | 9/1961 | Shepherd | 229/40 |
| 3,144,979 | 8/1964 | Young | 229/DIG. 3 |
| 3,189,420 | 8/1965 | Hiersteiner | 229/DIG. 3 |
| 3,294,312 | 12/1966 | Mullins | 229/53 |
| 3,386,642 | 6/1968 | Young | 229/40 |

*Primary Examiner*—Davis T. Moorhead
*Attorney, Agent, or Firm*—Philip Furgang

[57] ABSTRACT

Disclosed is a mailing carton having two opposed rectangular panels joined to and framed about all four edges by V-shaped panels. A book or other object having dimensions of length and width of substantially the same dimension as the rectangular panels is held within the container and cushioned by the V-shaped panels. The container can accommodate books of varying thicknesses.

8 Claims, 15 Drawing Figures

FIG. 14
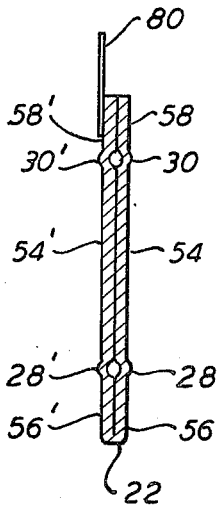
FIG. 12
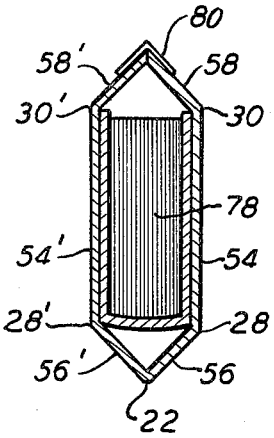
FIG. 11
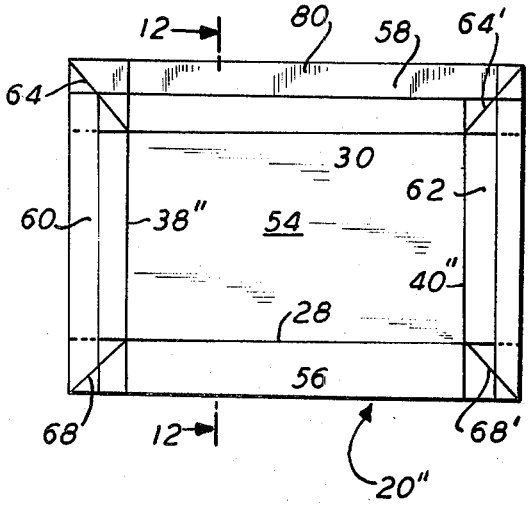
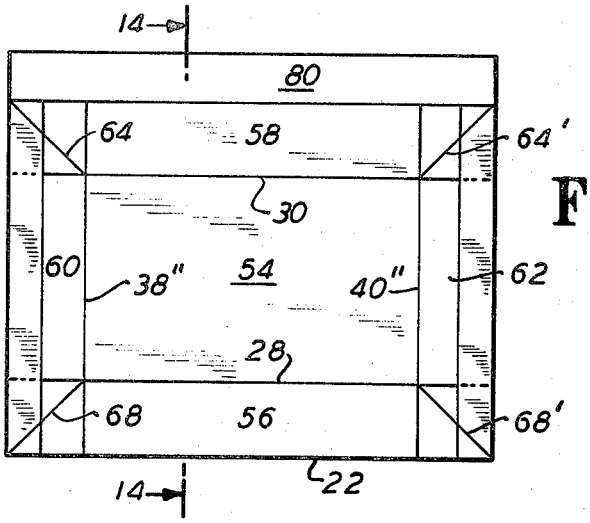
FIG. 13
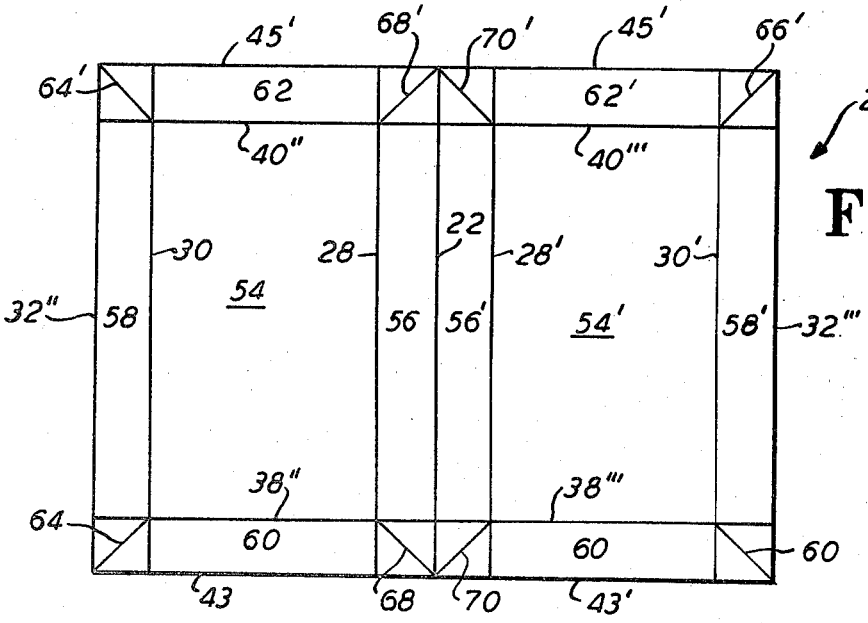
FIG. 15

MULTI-SIZE MAILING CARTON

BACKGROUND OF THE INVENTION

This invention is related to mailing cartons for fragile items such as books, phone records, photo albums, and the like and in particular, mailing cartons which provide protection for the side edges.

It has been observed that books are dimensionally standardized as to length and which but vary considerably as to their respective thickness. Thickness is determined by the number of pages, the thickness of the paper and of the cover, among other factors.

It has also been observed that postal regulations and prevailing standards make obiligatory that the contents within the carton be confined in a snug and shakeproof manner.

In the prior art, in conformance with said requirements, the rectangular mailing cartons for such items were devised to have the top and bottom panels and also the four side wall panels to conform to the dimensions of the contents. Since the basic blanks of such cartons are normally fabricated by means of cutting and creasing dies each variation of the thickness required an individual die. This necessity represents a substantial expense in the cost of such dies and of their storage.

There have been many attempts to provide boxes intended to protect the narrow edges of such objects as books. In the past, it has been common practice to contain books in containers made of corrugated cardboard but having somewhat larger dimensions of length and width than the object contained. Interior packaging is provided to hold the object in spaced relation to the end walls of the container. More recently, the use of recessed-end containers has increased. Containers of this type comprise sleeves having intergral closure flaps which extend inwardly of the container so as to engage the product and to hold it from relative movement with respect to the container. Such arrangements are exemplified by Boytel (U.S. Pat. No. 3,289,824) which discloses such flaps on three sides of a parallel sleeve rectangular container. Shirley (U.S. Pat. No. 2,591,882) and Nehers (U.S. Pat. No. 3,064,875) also disclose the use of end flaps folded in upon itself to form a rectangular cushion.

Johnson (U.S. Pat. No. 3,465,946) and Greene et al. (U.S. Pat. No. 3,485,435) suggest side panels interconnecting larger rectangular panels. The side panels of these containers are so disposed as to form channel-like flanges which terminate inwardly of the outer edges of the rectangular panels. The extension of the outer edges are intended to form a buffer to protect the edges of the book therewithin.

All of these suggestions have a number of difficulties in common. Firstly, the use of a complicated fold enabling the formation of air pockets at the narrow end of such containers invariably results in a variety of prescored widths of the container blank. As a result, dies of varying sizes are required in order to score the material from which such cartons or containers are made. With each new book, as might be expected, at least one dimension must change. Thus, while a publisher can hold length and width constant, for example, thickness (i.e., the number of pages) will change from book to book. This requires the manufacturer to maintain a great many dies — a plurality of each container of a different thickness of book.

With reference to cartons having inwardly-expanding flanges along the narrow edges thereof, such arrangements require different types of scoring. Thus, the inwardly-folded edges must be scored on one side of the container while other folds are scored along the opposed surface. The inward thrust of the narrow flap ends formed with the inward folds tend to injure the book as it comes in contact therwith. This may be particularly seen with reference to the device of Greene et al. in FIG. 4 of the patent referred to hereinabove, in which the inward edges of the flap directly contact the pages of the book. Assembly of such containers is complicated and time consuming.

SUMMARY OF THE INVENTION

It is an object of this invention to provide a shipping container which will hold goods in place providing a supportive air pocket around the narrow edges thereof.

It is a further object of this invention to provide a container which is simple in construction and economical in manufacture and use.

It is a further object of this invention to provide a container for holding books and the like and being capable of receiving objects having similar dimensions of length and height by differing in thickness.

It is a further object of this invention to provide a container for holding books and the like which is capable of holding a number of different books within the same carton in spaced relationship from the edges thereof.

In accordance with the objects of this invention, there is provided a mailing carton for holding books or other objects comprising a receptacle chamber defined by opposed four-sided rectangular panels for holding the object. In addition, there are provided V-shaped buffer chambers contiguous to and about all four of the four-sided panels of the receptacle chamber. The apices of the V-shaped panels extend outwardly of the receptacle chamber, thereby forming buffer chambers about the mailing carton to protect the object therein.

BRIEF DESCRIPTION OF THE DRAWING

FIG. 11 is a plan view of one side of an assembled container constructed in accordance with the teachings of this invention and having therein a book;

FIG. 12 is a sectional view of the container of FIG. 11 taken along lines 12—12;

FIG. 13 is a view of a blank of the container of FIG. 11 in a folded and collapsed condition;

FIG. 14 is a sectional view of a blank taken along lines 14—14; and

FIG. 15 is a plan view of a blank of the container of FIG. 11.

DESCRIPTION OF THE PREFERRED EMBODIMENTS

The proposed mailing carton offers an expandable side wall construction for use in combination with objects having standardized length and width dimensions. Thus, the carton is particularly useful in accommodating such objects of varying thicknesses without necessitating the use of individual dies.

This invention makes it practical to device a series of the more frequently used standardized mailing carton sizes and to produce and store them in quantities so as to make them commercially available without delay and at reduced costs. These reduced costs are the result of the need for less special or unscheduled production runs and lesser cost due to the reduced number of dies.

The rectangular mailing cartons of the prior art are frequently characterized by a rectangular receptacle chamber with two opposite extension compartments or air cells of a variety of constructions, usually on only two sides of the carton. By comparison, the carton of this invention offers four air cells thus yielding 100% peripheral protection.

In addition, the cells serve as expendable side walls and act to hold the contents relatively fixed within the carton.

It is believed customary to ship the basic blank of the carton to the packaging station and to form the carton around the contents. This represents a laborious and slow operation. The proposed carton is contemplated to be prefabricated into a collapsed two-ply unit with three sides closed, readily expandable for easy insertion of an object. This represents a significant improvement in efficiency at the packing station.

Figure 7:
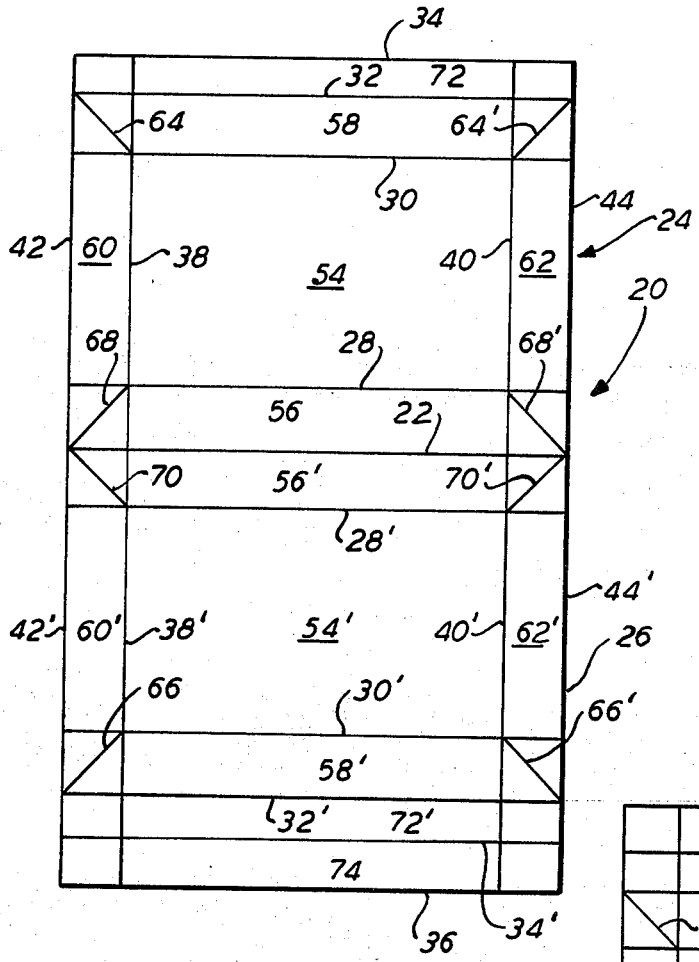
FIG. 7 is a plan view of a blank of the container of FIG. 1.
Figure 9:
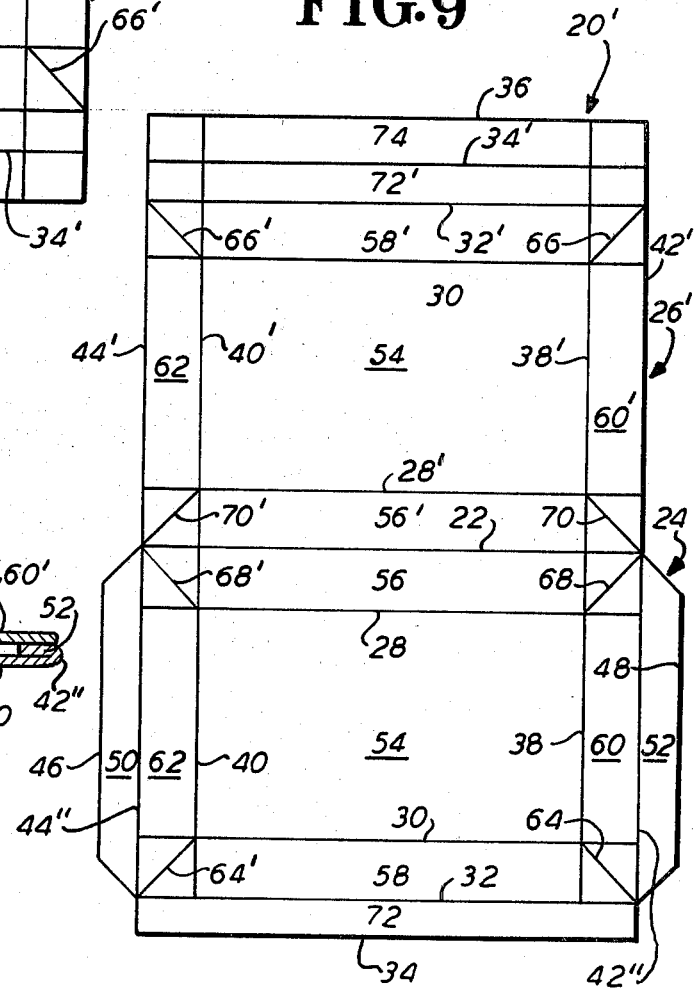
FIG. 9 is another blank constructed in accordance with the teachings of this invention.

Turning now to FIG. 7 and 9, there is disclosed two blanks 20 and 20′ having crease lines for the fabrication of the proposed container. Each blank 20 and 20′ may be made of a variety of fairly rigid paperboard preferably double-faced corrugated paperboard of substantially rectangular shape. Such material provided rigidity, strength, and capacity to cushion shock loads. In the alternative, the blanks 20 and 20′ may be made of any other fairly rigid paperboard materials.

The blanks 20 and 20′ (FIGS. 7 and 9) have center crease line 22 which divides the blanks 20 and 20′ into unequal halves 24 and 26, 24′ and 26′, respectively.

The shorter halves 24 and 24′ contain crease lines 28, 30, and 32 and terminal edge line 34, all of which are parallel to the center line 22. The longer halves 26 and 26′ respectively (FIGS. 7 and 9) have crease lines 26′, 28′, 32′, and 34′, as sell as terminal edge 36. All crease lines are parallel to the crease line 22 and are also parallel to the flutes of the corrugations. The crease line 34′ is intended to be in registry with the edge line 34 with the blank 20 and 20′ folded along the crease line 22.

At right angles to the aforementioned crease lines and terminal edge lines 28-36 and 28′-34′, are crease lines 38 and 38′ which are coterminous with one another and meet at the crease line 22, as well as similar crease lines 40 and 40′. At right angles as well are edge lines 42 and 42′ which are colinear and meet at the crease line 22 as well as the opposed edge lines 44 and 44′. It should be noted, however, that the corresponding edge or line in blank 20′ to edges 42 and 44 are defined by crease lines 42″ and 44″. There is further provided parallel edge lines 46 and 48 which define glue flaps 50 and 52.

The crease lines and terminal edges 28-48, 28′-34′, 38′-44′ partition the blanks 20 and 20′ into a plurality of panels. Thus, the area defined by crease lines 28, 30, 38, and 40, as well as 28′, 30′, 38′, and 40′ define rectangular panels 54 and 54′ respectively. Panels 54 and 54′ are part of the blank 20, as well as the blank 20′, are surrounded by and hingedly connected thereto by narrow rectangular panels 56, 58, 60, and 62 about panel 54 and 56′, 58′, 60′, and 62′ about panel 54′.

The smaller rectangular panels 56-62 and 56′-62′ are respectively defined by crease lines 28, 30, 38, 40, 28′, 30′, 38′, and 40′, as well as crease lines 32, 32′, 42″ (FIG. 9), 44″ (FIG. 9), as well as terminal edges 42, 42′, 44, and 44′.

The respective corners of the aforesaid panels 60 and 58, 58 and 62, 62 and 56, 60 and 56, 56′ and 62′, 62′ and 58′, 58′ and 60′, 60′ and 56′, overlap to form substantially square sections, each of which are bisected by diagonal crease lines 64, 64′, 66, 66′, 68, 68′, 70, and 70′.

On the shorter halves 24 (FIG. 7) and 24′ (FIG. 9), a terminal panel 72 extends from the crease line 32 to the edge line 34. Whereas on the longer half the panel 26 (FIG. 7), 26′ (FIG. 9) is provided with a terminal panel 72′ defined by crease lines 32′ and 34′. In addition, the larger half panel 26 and 26′ is surmounted by an additional terminal panel 74 which is hingedly connected from the crease line 34′ and is defined by the edge line 36.

In FIG. 9, an additional narrower panel 50 and 52 are hingedly connected along crease lines 42″ and 44″ respectively and defined by the edge lines 46 and 48.

Figure 4:
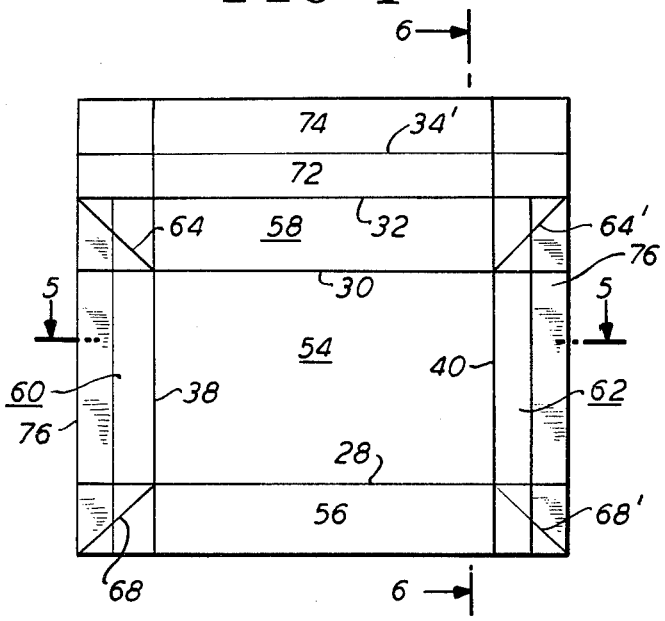
FIG. 4 is a plan view of a container of the type of FIG. 1 without an object therein.
Figure 5:
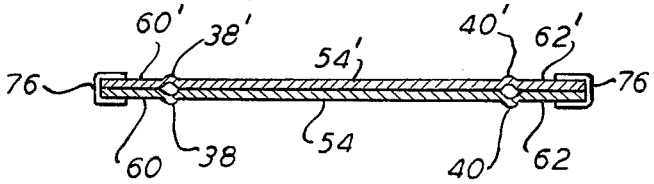
FIG. 5 is a sectional view of the container of FIG. 4 taken along 5—5.
Figure 6:
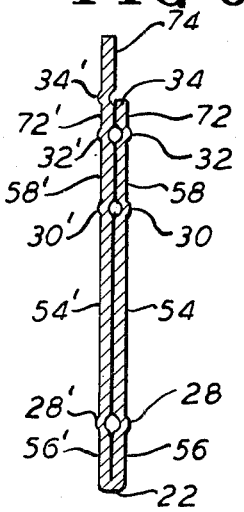
FIG. 6 is a sectional view of the container of FIG. 4 taken along lines 6—6.

With particular reference to the blank 20 in FIG. 7, this blank 20 may be folded into a carton by folding along crease line 22 as illustrated in FIGS. 4–6. Shown therein is a fully collapsed two-ply unit assembly.

In use, the conversion starts by pre-breaking various crease lines to be more fully discussed hereinafter. Next the halves are folded on the crease line 22 and placing in registry the panels 54 and 54′.

By folding the blank 20, the open ends defined by the edge lines 42 and 42′ as well as 44 and 44′ are in contact. These edges may be secured by any means such as adhesive tape 76, thereby uniting the opposite and opposed end panels 60, 60′ and 62, 62′ on their exterior surfaces.

Figure 10:
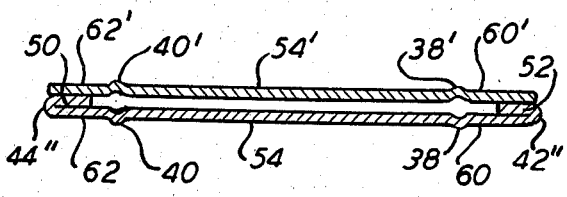
FIG. 10 is a sectional view of an assembled blank of FIG. 9.

The conversion of the basic blank 20′ of FIG. 9 is accomplished by first folding inwardly upon the blank 20′ the glue flaps 50 and 52 along the crease lines 42″ and 44″. Adhesive films may then be applied to the flaps 50 and 52 so that when the blank 20′ is folded along crease line 22, the glue flaps 50 and 52 will adhesively unite with the interior face of the panels 62′ and 60′ (FIG. 10).

The aforesaid methods of conversion between FIG. 7 and FIG. 9 are alternative preferred embodiments.

At the conclusion of the conversions as discussed hereinbefore, the carton is now ready for packaging.

Figure 2:
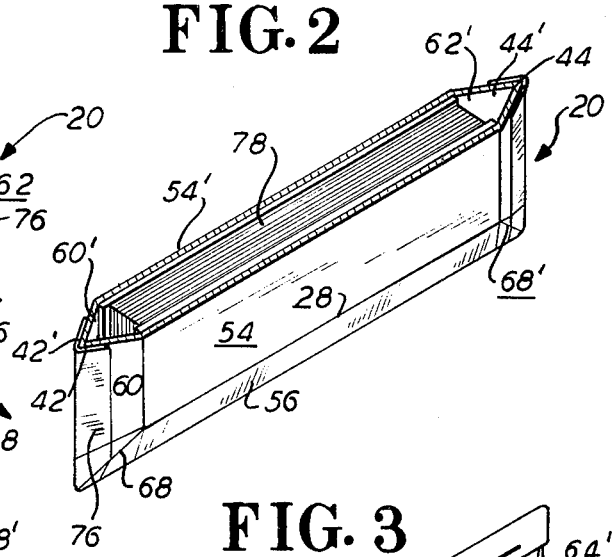
FIG. 2 is a perspective sectional view of the container of FIG. 1 taken along the lines 2—2.
Figure 3:
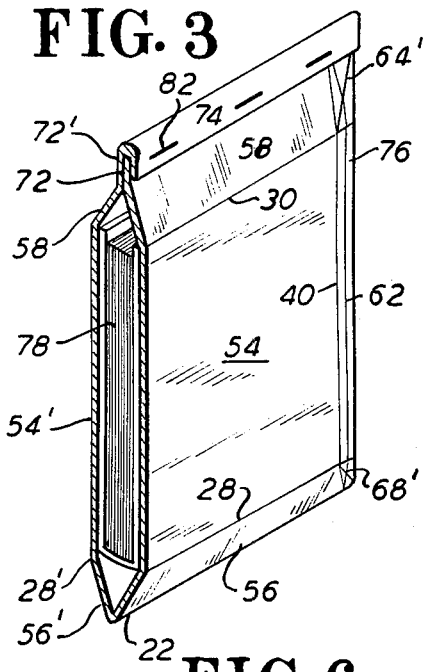
FIG. 3 is a perspective sectional view of the container of FIG. 1 taken along lines 3—3.

The interior space between the opposed rectangular panels 54 and 54′ (FIGS. 1–3) constitute the receptacle chamber for the contents. Viewed from another aspect, these panels 54 and 54′ represent the top and bottom panels of a receptacle chamber. The area of the panels is defined by the crease lines 28, 30, 38, 40, and 28′, 30′, 38′, 40′, and are intended to eventually coincide with the respective length and width of the contents which may be, for example, a book 78.

Figure 8:
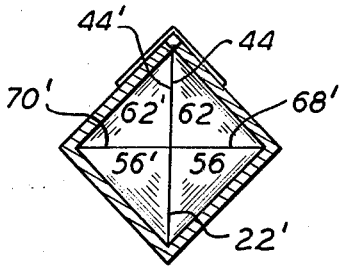
FIG. 8 is a sectional view of the container of FIG. 1 taken along lines 8—8.

The panels 56-62 and 56′-62′ perform several useful functions. First, they serve as the expandable side walls for the container to accommodate contents of varying thicknesses as compared to the side walls of fixed-type containers in the prior art. Secondly, they form V-shaped contiguous outwardly projected and fully circumferential buffer chambers which protect the peripheral edge of the contents. The diagonal creases 64-70 and 64′-70′, the four corners of these buffer chambers assume a pyramidal shape (FIG. 8) which further enhances the protective effect of the corners. Thirdly, due to the internal wedge shape of the buffer chambers. These chambers serve as a peripheral wedge lock for the contents to thereby limit any internal movement of the object with respect to the mailing carton. The wedge effect is accomplished due to the rigidity and firmness of fthe double-faced corrugated paperboard. Thus, the rigidity of the board selected to make the carton is an important consideration.

It should also be noted that the proposed formation of the buffer chamber or air cells represents an economy in board material as compared to the majority of air cell constructions in the prior art.

The panels 72 and 72′ serve as expandable mouth panels to provide access and guidance for the insertion of the object 78 into the receptacle chamber. In combination with the lid panel 74, the mouth panel 72 and 72′ serve as the closure of the opening of the carton.

Still another embodiment of this invention may be seen in FIGS. 11 through 15.

In this embodiment, the rectangular panels 72, 72′, and 74 are omitted and the crease lines 32 and 32′ are now designated as edge lines 32″ and 32‴. Otherwise, the remaining layout of crease and edge lines and of panels specified in the aforementioned FIGS. 7 and 9 remain unchanged.

In the proposed modified carton, the omitted panels are replaced by a relatively narrow tape strip 80 (FIGS. 11 through 14) which may be water-cured along half of its width to panel 58′. The adhesive film on the tape 80 may be of a well known type which is either water or heat activatable. The material of the tape 80 may be craft paper, textile, or plastic and shall be able to withstand the stresses applied thereto. The adhesive strip 80 is attached to the blank 20″ during the fabrication of the carton (FIGS. 13 and 14).

The aforesaid modification actually applies to the closure elements on the open side of the carton after the contents 78 are inserted therein. The major merit lies in the saving of board material, although there may be other advantages resulting therefrom. These may be obtained by comparative usage of each of the proposed embodiments herein.

In the packaging operation, the open side of the carton designated by the wall panels 58 and 58′ are first expanded to permit the insertion of the contents 78. Next the panels 58 and 58′ are brought together to allow the edge lines 32″ and 32‴ to abut. Next the adhesive film of the projecting half of the tape strip 80 is activated and folded over the exterior face of the panel 58. Finally, the tape 80 is brought into intimate pressure contact with the panel 58 to adhere thereto. The resulting package is illustrated in FIGS. 11 and 12.

It should be noted that, as demonstrated in connection with FIGS. 4–6 and 10, the fact that the proposed carton reaches the packaging station in a fully collapsed state, not exceeding the thicknesses of two plies of the board material, it is a distinct economic advantage in connection with both shipping and storage.

The fact that the carton reaches the packaging station prefabricated having three sides closed, and an expandable mouth opening saves several operational steps and apparatus as compared to the methods and means employed by the prior art.

Figure 1:
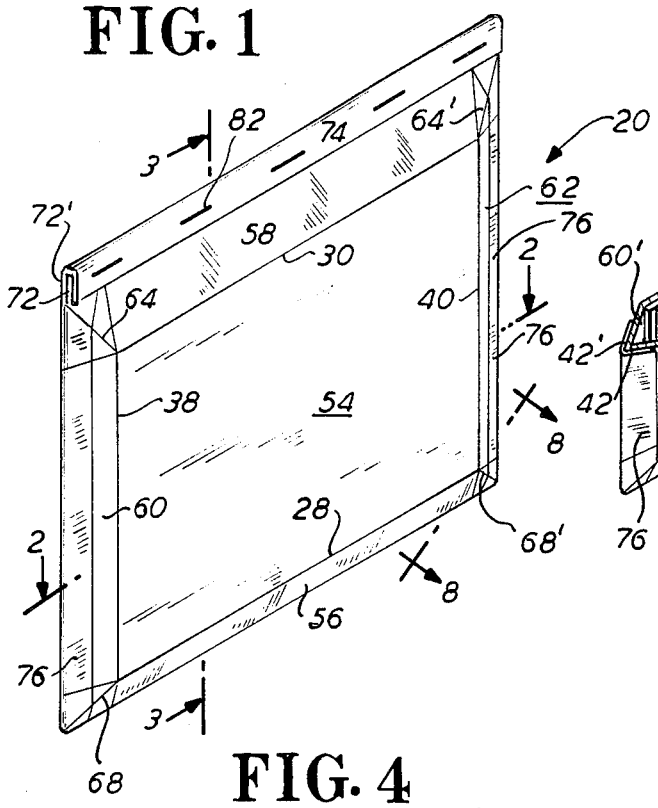
FIG. 1 is a perspective view of a shipping container constructed in accordance with the teachings of this invention.

The proposed packaging operation consists of expanding the mouth panels 72, 72′ (FIGS. 7 and 9) sufficiently to provide an opening in excess of the thickness of the contents 78. Next the contents 78 are inserted through the opening until they reach the crease lines 28 and 28′ of the receptacle chamber. Next the mouth panels 72 and 72′ are brought into intimate contact with each other and the lid panel 74 is folded over them and united with them into a three-ply combination (FIG. 1). Last, the closure panels 72, 72′ and 74 may be secured by any suitable commercial fastener such as wire staples, clips, or similar items 82.

It should be noted that the proposed structural combination, the collapsed carton having three sides closed, provides an enclosure with sufficient elasticity to permit the insertion of the contents 78 into the receptacle chamber. In view of the material used, however, the container would retain its natural tendency to return to its original collapsed state. In view of this tendency, there is established a moderate surface contact pressure by the interior faces of the panels 54 and 54′ against the contents 78 which combines with the wedge lock effect as previously discussed hereinbefore. These effects may be further enhanced by selectively creasing and pre-breaking the following crease lines. The crease lines 28 and 28′, 30 and 30′, 38 and 38′, 40 and 40′, may be lightly creased and only partly prebroken (not in excess of 90°). However, the crease lines 22, 32, 32′, and 34′, and (FIG. 9) 42″ and 44″ may be heavily creased and fully prebroken (up to 180°). As a result of the selective treatment of the area served by the lightly creased and partly pre-broken crease lines shall have a lesser elasticity. Consequently, the major angular movement resulting from the expansion of the container will take place at the outer areas at the crease lines 22 and 32 and 32′, the edge line 42, 42′, 44, and 44′ acting as pivots. The ultimate effect is tension at the peripheral edges of the object in the container and a snug shakeproof confinement. In addition, the thicker the contents the more tension results as the carton is expanded thereby.

It should be noted the effects of holding the contents securely within the mailing carton are directly related to the characteristics of the board material that is used.

In addition, it should be noted that the invention disclosed herein is extremely efficient in the material it uses. Thus, there is no waste portion, 100% of the blank area being used, in most of the embodiments disclosed herein. This is a marked departure from the prior art.

What is claimed is:

1. A blank of the type from which mailing cartons may be formed, said blank being of the type made of rigid paperboard and comprising:

a large and small rectangular panel hingedly secured to one another by a crease line; each panel having symmetrically disposed therein at equal distances from said joining crease a first, second, and third parallel crease lines; said larger panel having a fourth crease line at a distance from said joining crease line equal to a parallel terminal edge of said shorter panel; a plurality of crease lines perpendicular to said hinge crease line; said perpendicular and parallel crease lines extending the entire width and length, respectively, of said blank and defining therein at least two rectangular panels framed by smaller overlapping rectangular panels; diagonal crease lines symmetrically disposed about said blank bisecting said overlapping portions of said smaller rectangular panels.

2. A blank as recited in claim 1, wherein upon folding said first and second unequal rectangular panels along said hinged crease line, said parallel and perpendicular crease lines being so disposed such that one of said lines on one of said larger and smaller rectangular panels being aligned with each other.

3. A blank as recited in claim 2, further comprises adhesive tapes being secured along two terminal edges, said terminal edges being perpendicular to said crease line, along which said two unequal panels are hingedly joined, said tape securing said perpendicular smaller panels to thereby form a collapsed container having expandable sides.

4. A blank as recited in claim 3, further comprises narrow glue tabs hingedly secured along crease lines, said crease lines being perpendicular to said crease line hingedly joining said unequal opposed panels; said glue tabs constituting extensions projecting beyond the terminal edge lines of said opposed panel; adhesive applied to said glue panels for securing two of the four sides of the said mailing carton.

5. A blank as recited in claim 4, wherein said glue tabs are bent at 180°, thereby exposing one surface thereof to an opposed one of said vertical smaller rectangular panels such that upon folding said blanks along said hinged crease line, said adhesive joining said carton along two of the four sides thereof.

6. A mailing carton of the type intended to hold an object such as a book, record, or the like, each object having substantially predetermined width and length but wherein such objects may vary one from the other in thickness, said mailing carton comprising:

a. one continuous sheet of double-faced corrugated paperboard folded upon itself to form opposed members;

b. said members having crease lines in registry with one another and extending parallel, perpendicular and at a diagonal to said folds;

c. said crease lines defining within said members two substantially identically dimensioned four sided panels, said panels being substantially dimensioned to the width and length of the object to be held by said cartons;

d. said crease lines further defining panels framing said four sided panels;

a first pair of said framing panels being hingedly joined at said fold thereby forming a V-shaped expandable buffer chamber with the apex thereof extending outwardly of said foursided panels;

e. said framing panels extending perpendicularly to said fold having their terminal edges co-terminous with the marginal edges of said sheet;

f. tape means having greater flexibility than said sheet for joining said opposed perpendicular panels at said terminal edges to thereby form two V-shaped buffer panels perpendicular to said folds with the apices of said V-shaped buffer chambers extending outwardly of said four sided panels;

g. said remaining framing panels forming in combination a fourth V-shaped buffer chamber thereby providing V-shaped expandable buffer chambers contiguous and about all four sides of said four sided panel; and h. means for closing said carton hingedly joined to said fourth buffer panel;

7. A mailing carton as recited in claim 6 wherein said means for closing comprises:

a pair of opposed rectangular mouth panels hingedly secured to said remaining framing panels for admitting therethrough the object;

a rectangular lid panel hingedly secured to one of said mouth panels at a crease line to thereby form an enlarged mouth opening;

said lid panel being foldable over said opposed rectangular mouth panel for closing said container; and means for securing said lid panel to said mouth panel thereby sealing said mailing carton.

8. A blank of the type from which mailing cartons may be fabricated, said blank being of the type made of rigid paperboard comprising:

equal rectangular panels hingedly secured to one another by a joining crease line and defining at the marginal edges thereof said blank; each of said panels having symmetrically disposed, at equal distances from said joining crease line, first and second parallel crease lines and first and second perpendicular crease lines, thereby defining within said rectangular panels symmetrically disposed rectangular panels framed by smaller dimensioned rectangular panels; said smaller dimensioned rectangular panels overlapping; and diagonal crease lines symmetrically disposed about said blank bisecting said overlapping portion of said smaller rectangular panels; and narrow glue tabs hingedly secured along crease lines, said crease lines being perpendicular to said crease lines lying hingedly joining said equal panels; said glue tabs constituting extensions projecting beyond the terminal edge lines of said opposed panels; adhesive applied to said glue panels for securing two of the four sides of said mailing carton.

* * * * *